US008646847B2

(12) United States Patent
Cochran et al.

(10) Patent No.: US 8,646,847 B2
(45) Date of Patent: Feb. 11, 2014

(54) MANHOLE REMOVER

(75) Inventors: Gary L. Cochran, Colwich, KS (US); Dennis Skraba, Inno, SC (US)

(73) Assignee: Coneqtec Corp., Wichita, KS (US)

( * ) Notice: Subject to any disclaimer, the term of this patent is extended or adjusted under 35 U.S.C. 154(b) by 677 days.

(21) Appl. No.: 12/903,697

(22) Filed: Oct. 13, 2010

(65) Prior Publication Data

US 2011/0084540 A1 Apr. 14, 2011

Related U.S. Application Data

(60) Provisional application No. 61/251,500, filed on Oct. 14, 2009.

(51) Int. Cl.
*E21C 25/00* (2006.01)

(52) U.S. Cl.
USPC ..... 299/39.4; 299/39.6; 299/41.1

(58) Field of Classification Search
USPC ..... 299/39.3, 39.4, 39.6, 41.1; 414/621, 414/741, 746.5
See application file for complete search history.

(56) References Cited

U.S. PATENT DOCUMENTS

| | | | | |
|---|---|---|---|---|
| 2,650,477 | A * | 9/1953 | Stine | 414/745.2 |
| 3,958,704 | A * | 5/1976 | Wire et al. | 414/733 |
| 4,458,949 | A | 7/1984 | Jury | |
| 4,924,951 | A | 5/1990 | Paulson | |
| 4,968,101 | A | 11/1990 | Bossow | |
| 5,470,131 | A | 11/1995 | Nolan et al. | |
| 5,522,646 | A | 6/1996 | Friedman et al. | |
| 6,223,838 | B1 | 5/2001 | Dengel et al. | |
| 6,609,742 | B1 * | 8/2003 | Macom et al. | 294/82.13 |
| 6,709,064 | B2 | 3/2004 | Nettek | |
| 7,494,191 | B1 * | 2/2009 | Crites | 299/41.1 |
| 7,703,856 | B1 | 4/2010 | Duncan | |
| 7,740,415 | B1 | 6/2010 | Crites | |
| 8,011,851 | B1 * | 9/2011 | Crites | 404/94 |

FOREIGN PATENT DOCUMENTS

DE 3319586 A1 * 12/1984

* cited by examiner

*Primary Examiner* — David Bagnell
*Assistant Examiner* — Michael Goodwin
(74) *Attorney, Agent, or Firm* — Woodard, Emhardt, Moriarty, McNett & Henry LLP

(57) ABSTRACT

A device and system for removing structures embedded in surrounding material is disclosed. Embodiments include a powered, expandable clamp attached to a rotating cutting tool for removing manholes from roadways. Select embodiments include anchoring a clamp to a manhole and using the manhole itself as leverage to move a cutting device through the surrounding material. Alternate embodiments allow an operator, working alone from a control station, to secure the manhole remover to the manhole, cut through the surrounding roadway, remove the manhole, and deposit the manhole at another location without requiring the operator to leave the control station. Further embodiments optionally include a depth gauge indicating the penetration depth of the cutting tool, an indicator reflecting the expanded state of the clamp, a pendulum mount allowing the clamp and drum to vertically orient using gravity, and/or the ability to attach to a host machine, such as a skid-steer loader.

20 Claims, 19 Drawing Sheets

MANHOLE REMOVER

This application claims the benefit of U.S. Patent Provisional Application No. 61/251,500, filed Oct. 14, 2009, which is hereby incorporated by reference in its entirety.

FIELD OF THE INVENTION

The disclosed embodiments relate generally to devices and systems for removing embedded structures from their surrounding material, for example removing manhole structures and assemblies from surfaces such as roadways. The embodiments are described in the context of systems that are added to prime movers, such as skid-steer loaders, but are useful in other applications as well.

BACKGROUND

In normal use, a skid-steer loader frequently has a loader bucket pivotally attached to two front lift arms. Optionally, the loader bucket of a skid-steer loader may be removed and alternate or auxiliary implements, such as a manhole remover, may be attached to cut through the material surrounding a manhole, for example a concrete or asphalt road surface, to remove the manhole assembly from the ground.

SUMMARY

In some embodiments of the present invention, it is desirable for the manhole remover to be positively attached to the manhole as leverage for forcing a cutting device (or saw) downward through the material surrounding the manhole. For example, in one embodiment an expanding clamp is attached to the inner diameter of the manhole and a rotating cutting drum is forced downward into the pavement surrounding the manhole by pulling against the connection between the expanding clamp and the manhole. In certain embodiments, the clamp expands radially outward from a central region. In alternate embodiments, the expanding clamp is powered and includes, for example, a hydraulic cylinder that is attached to one or more clamping plates by one or more actuator links, where the one or more actuator links push the one or more clamping plates outward as the clamping cylinder piston rod moves in one direction and pull the one or more clamping plates together as the clamping cylinder piston rod moves in the opposite direction. In certain embodiments, the cutting drum includes one or more debris removers that move debris generated by the cutting points (also referred to as cutting teeth) away from the cutting points.

Certain embodiments of the present invention address these issues.

DESCRIPTION OF THE ILLUSTRATED EMBODIMENTS

Figure 1:
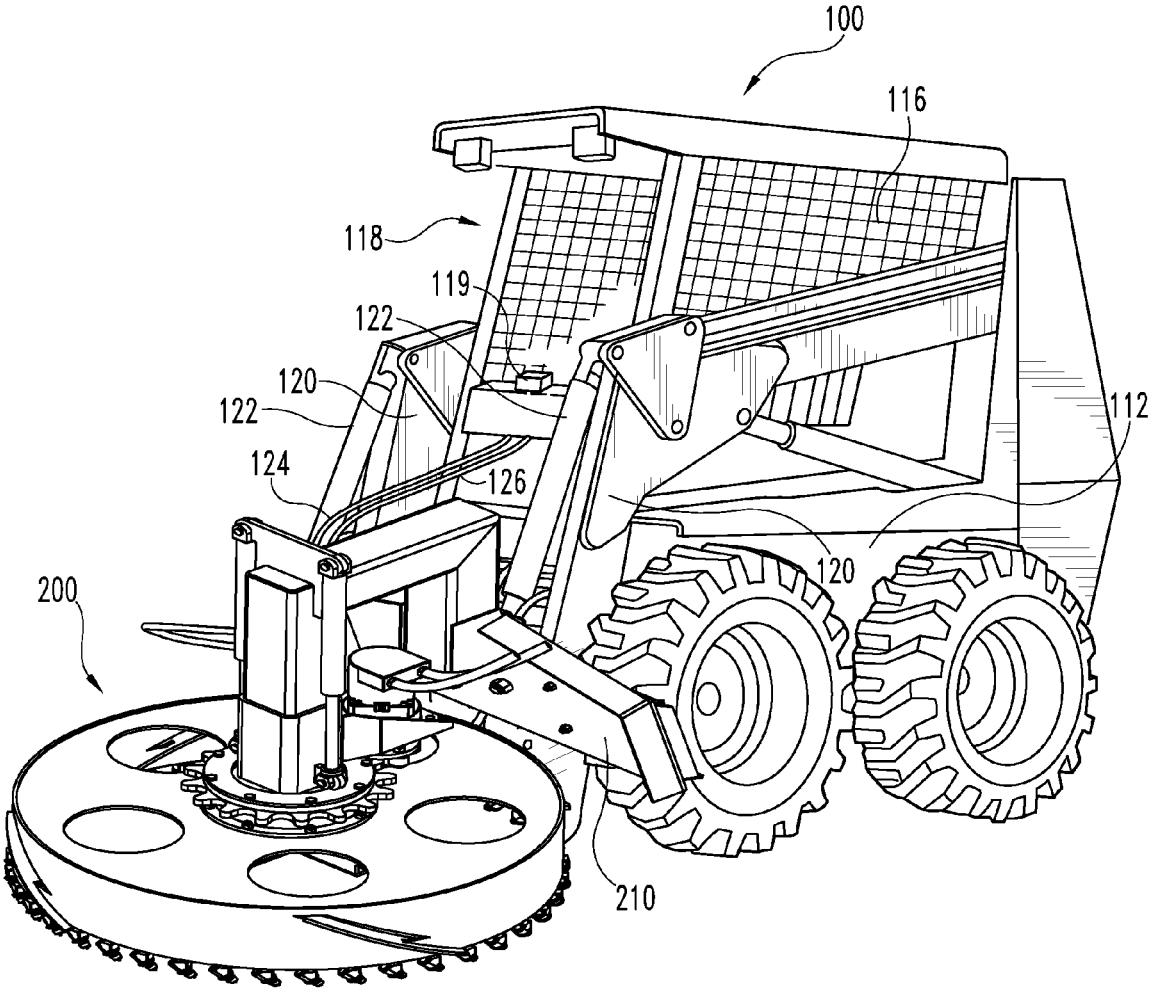
FIG. 1 is a front perspective view of a skid-steer loader and a manhole remover according to one embodiment of the present invention.
Figure 2:
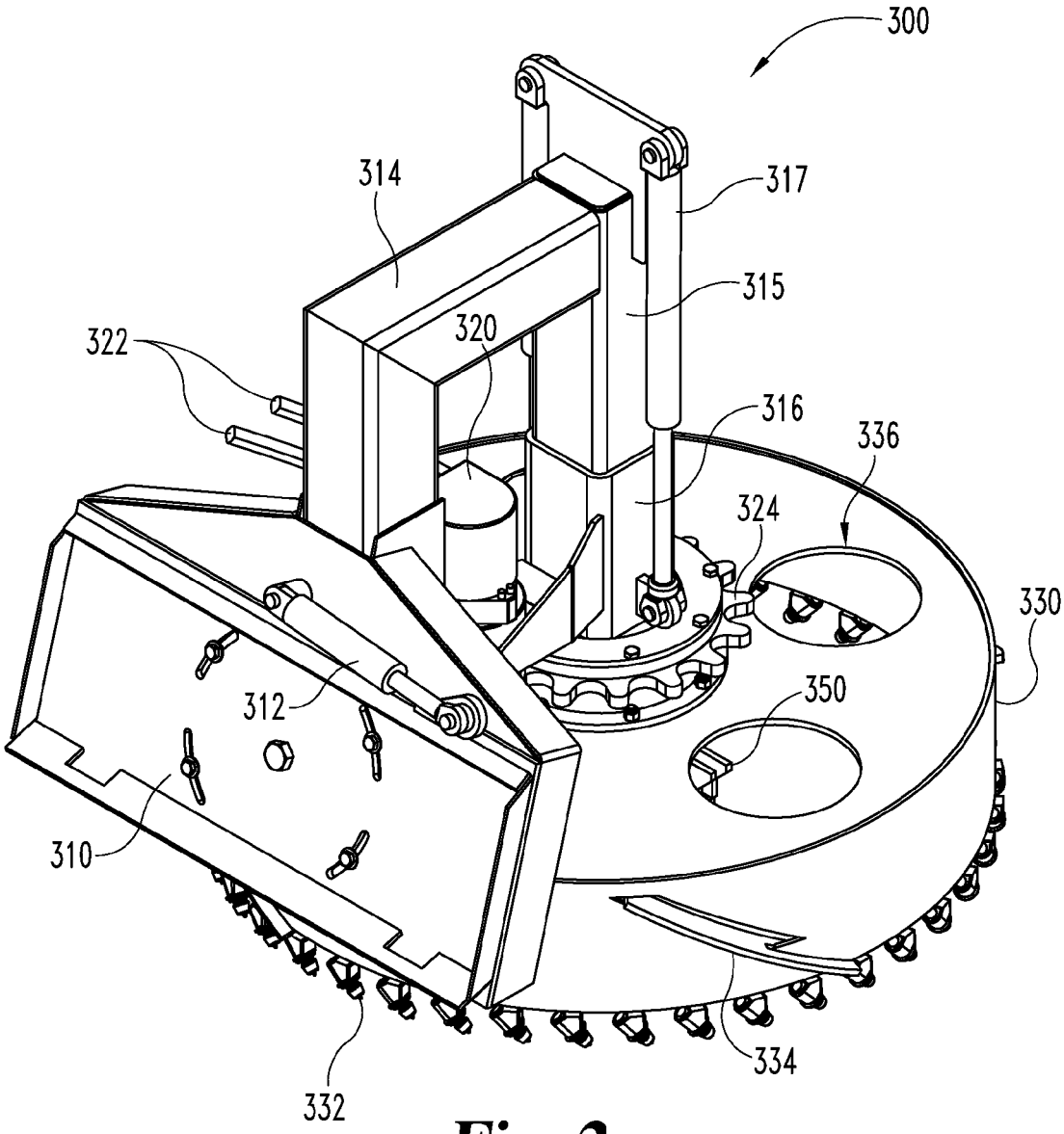
FIG. 2 is a rear perspective view of a manhole remover as viewed from above the manhole remover according to another embodiment of the present invention.
Figure 3:
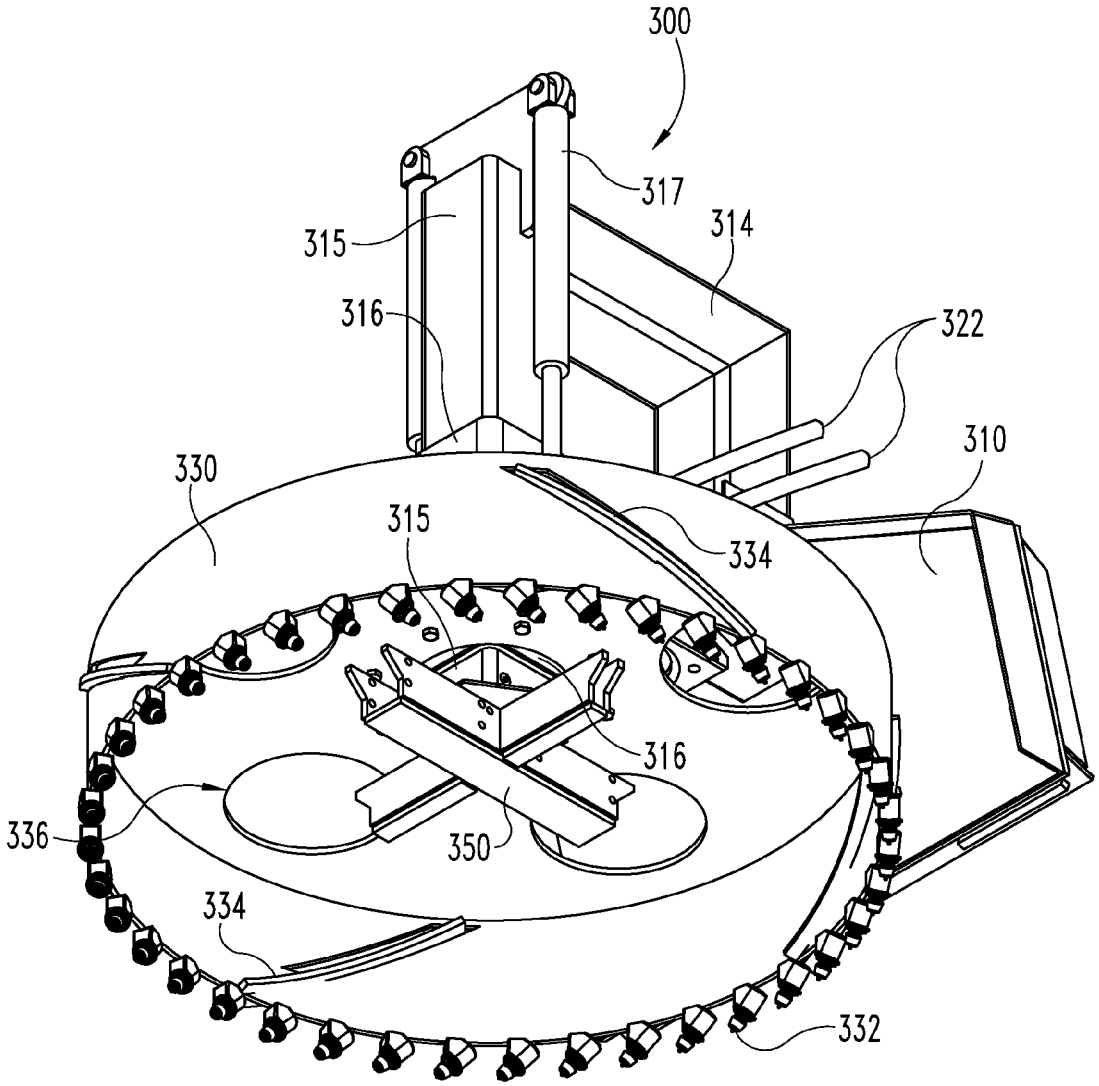
FIG. 3 is a front perspective view of the manhole remover depicted in FIG. 2 as viewed from beneath the manhole remover.
Figure 4:
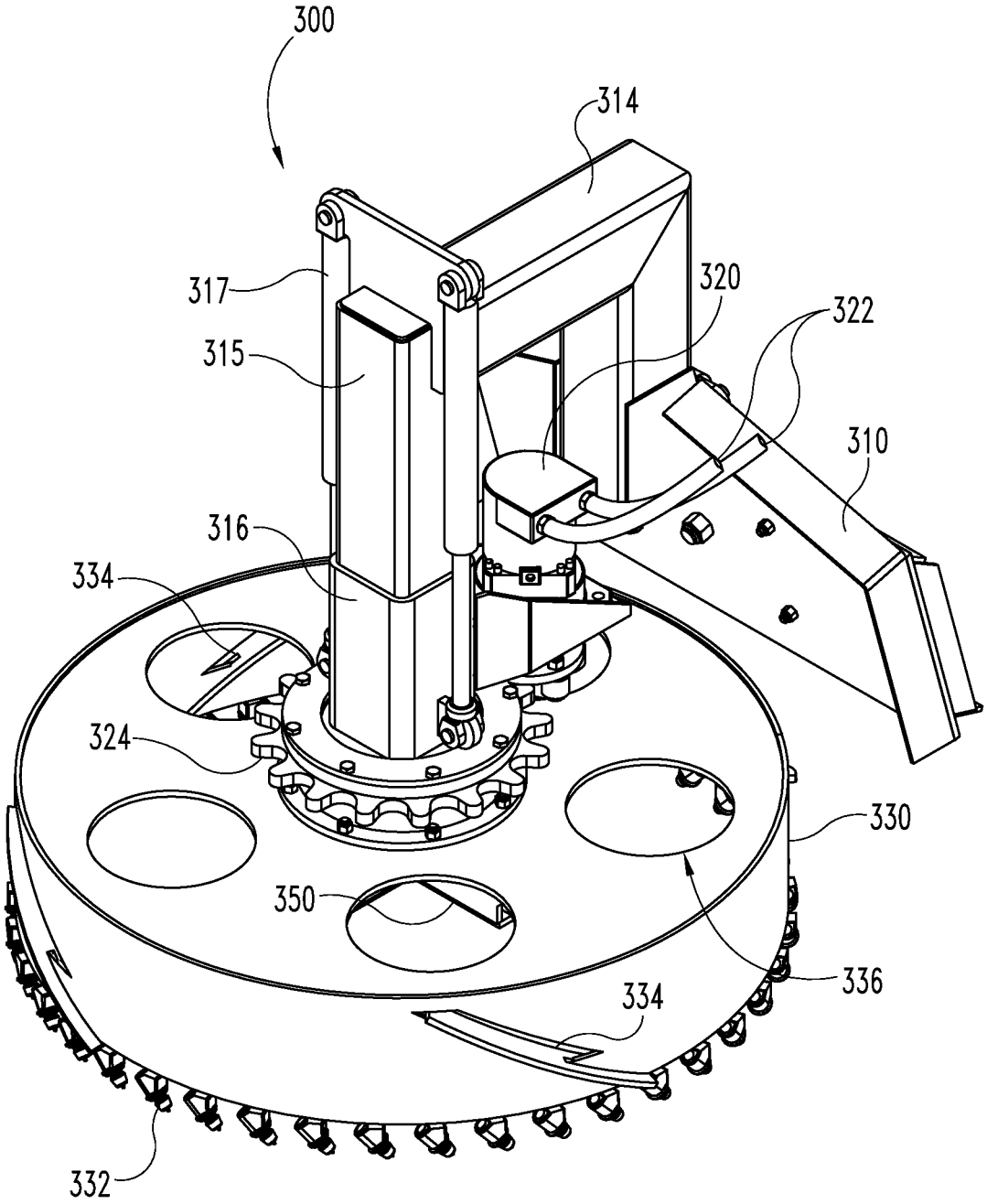
FIG. 4 is a front perspective view of the manhole remover depicted in FIG. 2 as viewed from above the manhole remover.
Figure 5:
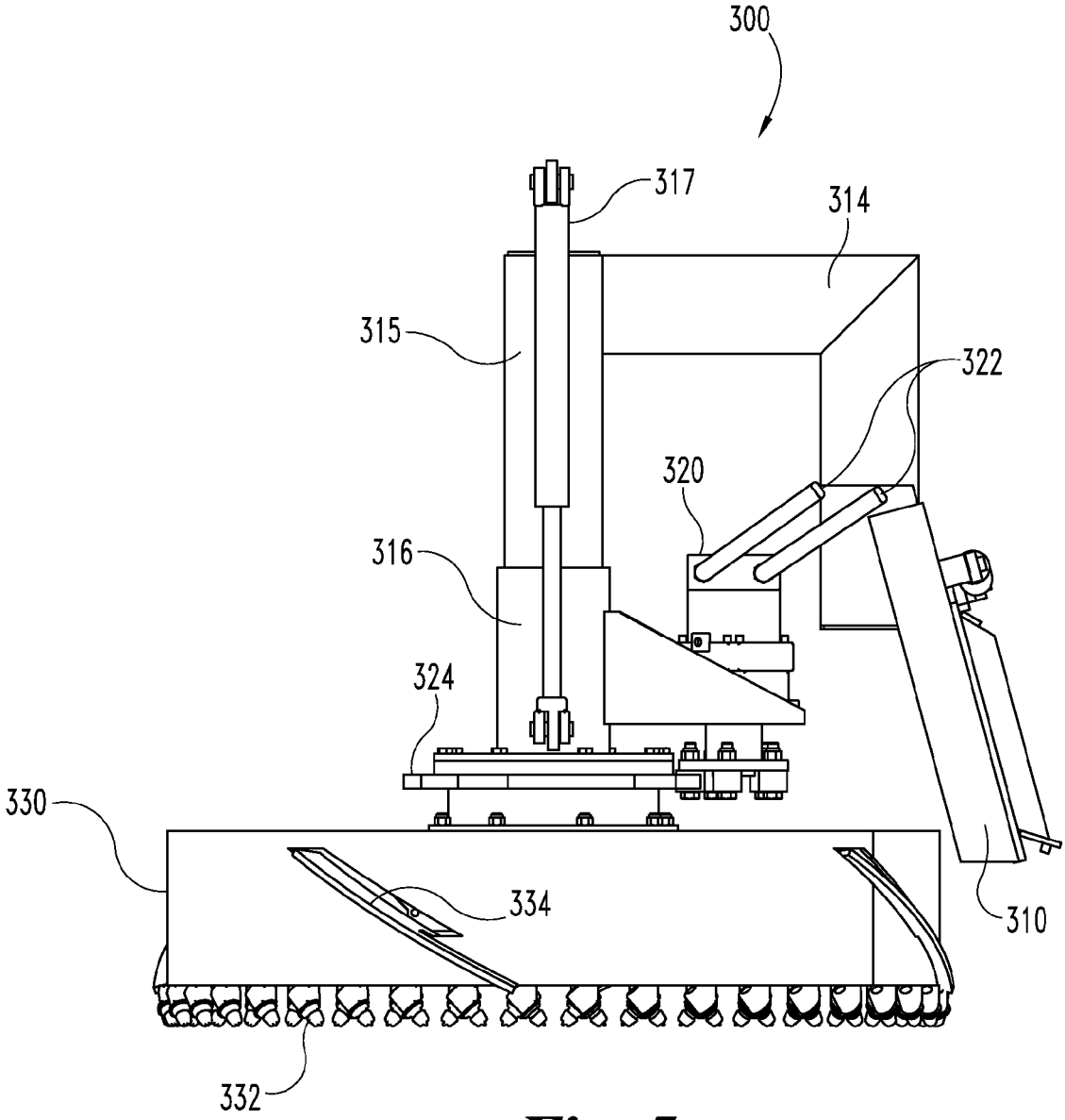
FIG. 5 is a side elevational view of the manhole remover depicted in FIG. 2.
Figure 6:
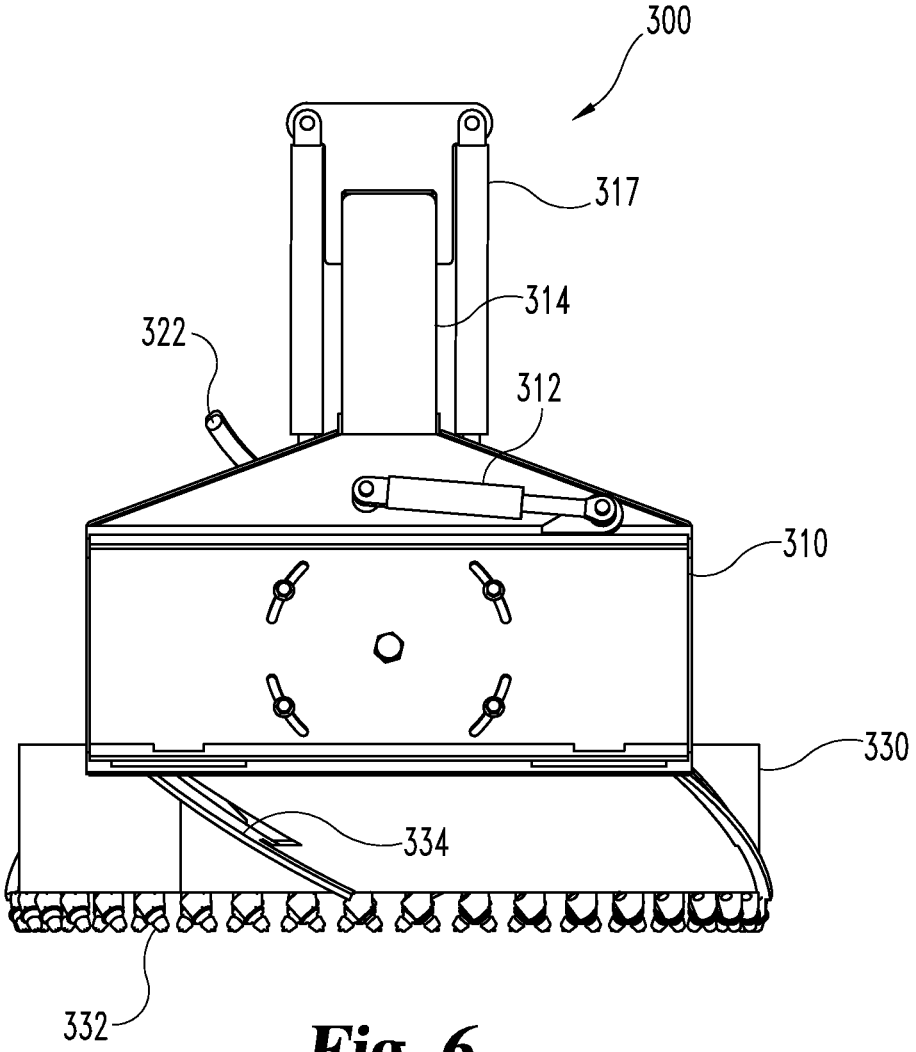
FIG. 6 is a rear elevational view of the manhole remover depicted in FIG. 2

For the purposes of promoting an understanding of the principles of the invention, reference will now be made to the selected embodiments illustrated in the drawings and specific language will be used to describe the same. It will nevertheless be understood that no limitation of the scope of the invention is hereby intended, such alterations, modifications, and further applications of the principles of the invention being contemplated as would normally occur to one skilled in the art to which the invention relates. At least one embodiment of the invention is shown in great detail, although it will be apparent to those skilled in the relevant art that some features or some combinations of features may not be shown for the sake of clarity.

Referring generally to FIG. 1 there is shown a skid-steer loader as an example support vehicle with an example device for removing an embedded structure (such as a tube or a structure with a hollow portion) from its surrounding material, such as manhole remover 200, attached. A typical skid-steer loader 100 is a type of support vehicle having a frame 112, four wheels or tracks, an operator position, such as a cage or cab 116 with a seat 118, and a pair of left and right front lift arms 120. Left and right hydraulic cylinders 122 may be paired with lift arms 120. Various alternate powered work tool implements may be interchangeably mounted to the skid-steer loader, for example by being coupled and uncoupled from the lift arms 120.

As illustrated, manhole remover 200 includes a mounting frame 210 generally configured to be mounted to the left and right arms 120 of the skid-steer loader 100 and optionally the left and right hydraulic cylinders 122. In one embodiment, brackets are provided at the rear of the mounting frame 210, allowing the manhole remover to be attached to the lift arms 120 and/or cylinders 122. Left and right lift arms 120 and the left and right hydraulic cylinders 122 may function in concert to pivot the orientation of mounting frame 210 and the manhole remover. In a particular embodiment, mounting frame 210 is configured as a debris shield.

Skid-steer loader 100 may include a hydraulic power system, which may be selectively coupled directly or through an interface to certain work implements to provide hydraulic power to the implements. Example supply lines 124 and return lines 126 are shown. Generally the skid-steer loader and any work implements are controlled by an operator through a control 119 located adjacent the operator position. In some skid-steer loaders, the operator enters the operator position from the front of the vehicle.

In certain embodiments, a manhole remover is based on a cutting drum with cutting teeth or points mounted along one edge of the drum. Hydraulic power may be supplied to rotate the cutting drum so that the teeth cut into the surface. Hydraulic power may also be used to force the cutting drum downward to a desired depth. The manhole remover may be mounted on a host machine, such as a skid-steer loader, or it may operate independently, for example when mounted to a frame, trailer or trolley.

Turning to FIGS. 2-6, a manhole remover 300 is depicted according to another embodiment of the present invention. Manhole remover 300 includes a mounting frame 310, which can be connected to the lift arms 120 of skid-steer loader 100. Attached to mounting frame 310 is a tilting mechanism, for example hydraulically actuated left-right tilt cylinder 312, and a support arm, for example extension arm 314. (For illustrative purposes, the hydraulic supply and return lines for left-right tilt cylinder 312 are not depicted). Actuation of left-right tilt cylinder 312 tilts extension arm 314 and cutting drum 330 with respect to mounting frame 310 and allows the operator to adjust the tilt of the cutting drum 330 relative to the manhole and the pavement surrounding the manhole.

Extension arm 314 includes a tube 315 and a sleeve tube 316. Sleeve tube 316 slidingly engages tube 315 and is connected to a rotatable cutting drum 330. One or more clamp actuators, for example clamping cylinder 360 (discussed in more detail below), and one or more actuators, for example extension cylinders 317, are attached to tube 315. The other ends of the one or more extension cylinders 317 are attached to sleeve tube 316. (The hydraulic supply and return lines for extension cylinders 317 are not depicted for clarity). By extending the one or more extension cylinders 317, sleeve tube 316 lowers and advances downward toward the pavement. Conversely, by contracting the one or more extension cylinders 317, sleeve tube 316 rises and retracts away from the pavement.

Cutting drum 330 is rotatably connected to sleeve tube 316. As such, extending the one or more extension cylinders 317 extends sleeve tube 316, and correspondingly moves cutting drum 330 downward toward and into the pavement. Likewise, contracting the one or more extension cylinders 317 retracts and raises cutting drum 300 out of and away from the pavement.

In the illustrated embodiment, tube 315 and sleeve tube 316 are square in cross-section. However, in alternate embodiments tube 315 and sleeve tube 316 include other cross-sectional shapes that provide for the rotation, extension and retraction of cutting drum 300.

Drive motor 320 is also attached to extension arm 314 and rotates cutting drum 330. In the depicted embodiment, drive motor 320 is connected to sleeve tube 316 and is hydraulically actuated by hydraulic lines 322. Drive motor 320 and a drive gear engage and rotate a rotational gear 324, which is attached to cutting drum 330. As such, as drive motor 320 drives and rotates rotational gear 324, cutting drum 330 also rotates. Alternate drive connections from a motor to the cutting drum could include, for example, a chain drive or belt drive.

Cutting points 332 are arranged along the bottom edge of cutting drum in either an integral arrangement or in mountings. Points 332 rotate against the surface surrounding the manhole breaking apart and cut through the material surrounding the manhole as cutting drum 330 descends. Although points 332 are depicted as extending downward in a direction that is generally parallel to the outer surface of cutting drum 330 (i.e., generally within the same cylinder as the cutting drum 330), alternate embodiments include points 332 that extend downward at different angles with respect to cutting drum 300. In other words, alternate embodiments include points that are angled inward toward the center of cutting drum 330 and/or points that are also angled outward away from the center of cutting drum 330 to cut a wider path as cutting drum 330 extends downward into the pavement.

Optionally, debris removers 334 extend from the side surfaces of cutting drum 330. As the cutting drum 330 rotates, the debris removers 334 preferably assist in removing the broken apart material (debris) surrounding the cutting drum 330 away from points 332 and from the hole being cut.

Cutting drum 330 further includes apertures 336 that reduce the weight of cutting drum 330. Apertures 336 provide locations where debris removed to the inside of cutting drum 330 by debris removers 334 can escape as cutting drum 330 extends into the pavement surrounding the manhole. Apertures 336 also enable operators to view and access the inside portions of drum 330, which include manhole clamp 350.

With reference to FIGS. 3 and 7-9, a manhole clamp 350 is attached to the lower end portion of tube 315. Brackets 386 (see FIG. 9) are attached to tube 315 by using, for example, bolts extending through apertures 387 and through complimentary apertures in tube 315. In other embodiments, other mechanisms for attaching manhole clamp 350 to tube 315, such as welding, can be used to attach manhole clamp 350 to tube 315.

Manhole clamp 350 is an expanding-type clamp that attaches to the inner surface of the manhole to be removed. One or more engagement members, for example clamping plates 370, are actuated to engage the manhole and securely hold manhole clamp 350 to the manhole. Manhole clamp 350 includes cross-beams, for example, cross-beams 352 and 354, that extend at least partially into the manhole (after the manhole cover is removed) as manhole clamp 350 is lowered into the manhole. In the illustrated embodiment, cross-beam 352 includes side walls 352A and bottom plates 352B, and cross-beam 354 includes side walls 354A and bottom plate 354B. (Note that in FIGS. 7 and 8 a second side wall 354A of cross-beam 354 is not shown to provide a clearer depiction of the connection between clamping cylinder 360 and clamping plates 370). Cross-beam side walls 352A are attached, such as by welding, to cross-beam bottom plates 352B. Similarly, cross-beam side walls 354A are attached, such a by welding, to cross-beam bottom plates 354B.

In the illustrated embodiment cross-beam 352 includes two separate halves, each of which includes two cross-beam side walls 352A and one cross-beam bottom plate 352B. The two halves of cross-beam 352 are attached to cross-beam 354 by, for example, welding, to form a sufficiently robust structure that permits connection to and removal of a manhole without, for example, the individual cross-beam components separating from one another.

The ends of cross-beams 352 and 354 further include centering portions, for example sloped portions 353 and 355 (respectively), that are sized to rest atop the upper rim (upper edge) of the manhole and assist in centering manhole clamp 350 within the manhole.

Attached to cross-beam side walls 354A are brackets 371. (Note in FIGS. 7 and 8 two brackets 371 are not shown to provide a clearer depiction of the connection between clamping cylinder 360 and clamping plates 370). Brackets 371 are positioned above cross-beam bottom plate 354B to form a channel between brackets 371 and bottom plate 354B that limits the vertical movement of clamping plate 370 while permitting clamping plate 370 to slide between a retracted position (depicted in FIG. 7) to an extended position (depicted in FIG. 8). Brackets 371 are attached to cross-beam side walls 354A using bolts 374, although in alternate embodiments other techniques for attaching bracket 371 to cross-beam side wall 354A, for example welding, may be used.

Clamping cylinder 360 is attached to tube 315 and extends downward through the interior of tube 315. Clamping cylinder 360 includes clamping cylinder barrel 362 and clamping cylinder piston rod 364. One or more actuator links 366 are pivotally connected to clamping cylinder piston rod 364 with, for example, bracket 368 and pin 369. Actuator links 366 are also pivotally connected to a cross-beam, for example cross-beam 354, with pins 367. Still further, actuator links 366 are pivotally connected to one or more clamping plates 370 with, for example, U-shaped brackets 372 and pins 373. As illustrated, actuator links are angled to form bell crank lever arrangements.

Figure 7:
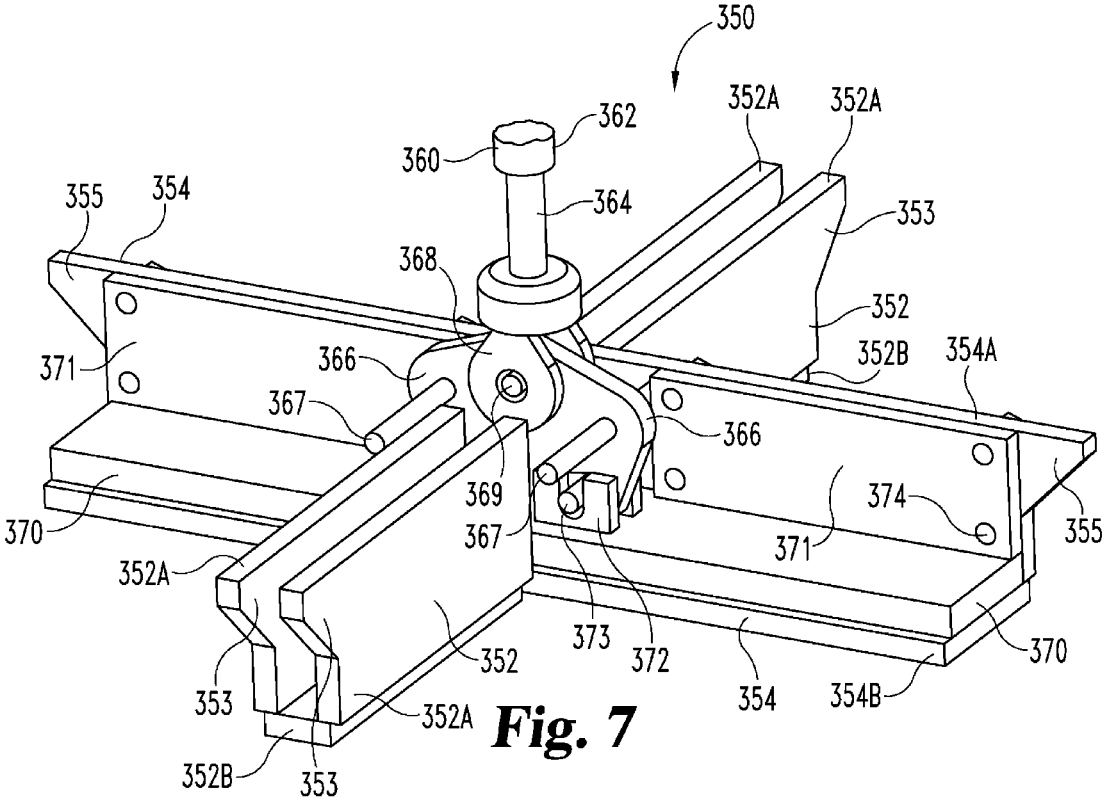
FIG. 7 is a fragmentary perspective view of the manhole clamp depicted in FIG. 3 with a portion of a cross-beam removed for illustrative purposes and the clamping plates in a retracted position.
Figure 8:
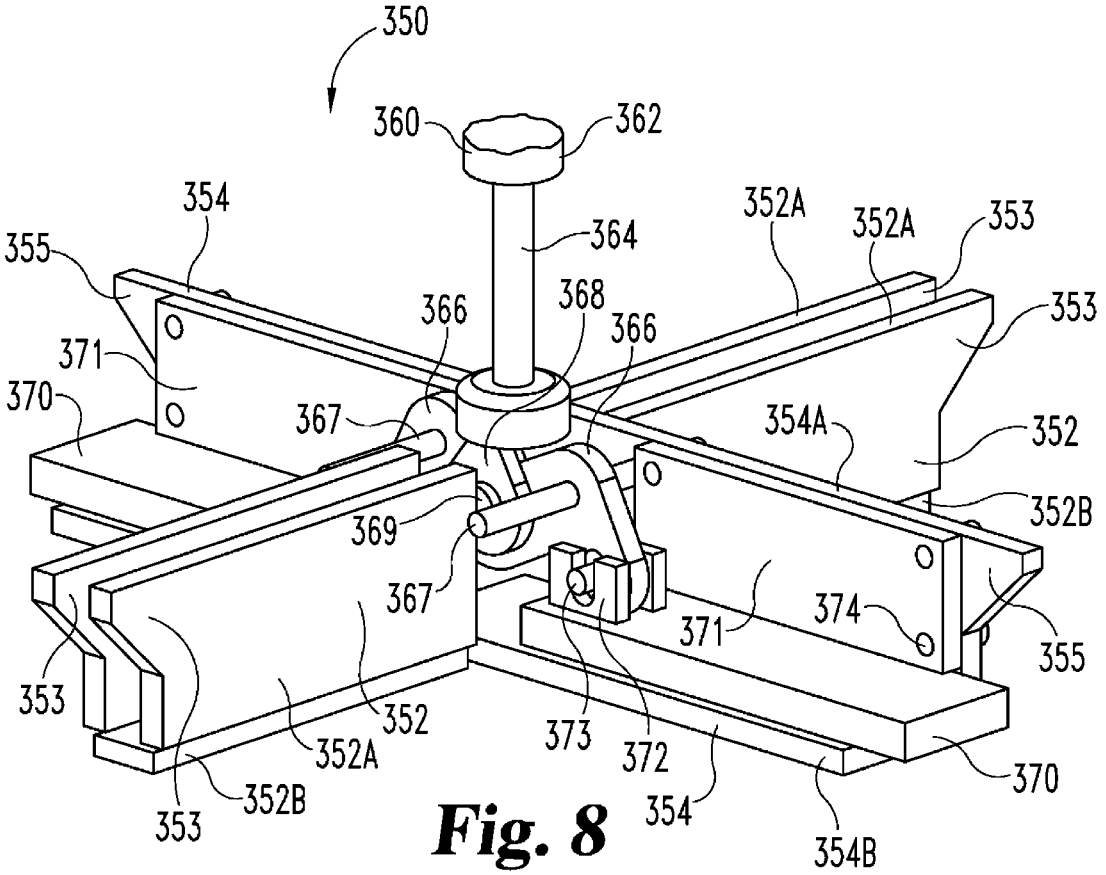
FIG. 8 is a fragmentary perspective view of the manhole clamp depicted in FIG. 3 with a portion of a cross-beam removed for illustrative purposes and the clamping plates in an extended position.

As clamping cylinder piston rod 364 and bracket 368 extend downward and push on the one or more actuator links 366, the one or more actuator links 366 rotate about pins 367 and push clamping plates 370 outward to slide from the retracted position depicted in FIG. 7 to the extended position depicted in FIG. 8. The actuator links 366 rotate in opposite directions and the plates 370 move outward in opposite directions. As clamping cylinder 360 and bracket 368 retract upward and pull on the one or more actuator links 366, the one or more actuator links 366 rotate in the opposite direction and pull clamping plates 370 from the extended position depicted in FIG. 8 to the retracted position depicted in FIG. 7. The actuator links 366 rotate in opposite directions and the plates 370 move inward in opposite directions. If the orientation of tube 315 is generally vertical, the actuator links 366 (bell cranks) convert the generally vertical movement of piston rod 364 to a generally horizontal movement of the plates 370.

The connections between brackets 372 and actuator links 366 accommodate the circular movement of actuator links 366 at the locations where actuator links 366 connect to brackets 372. For example, brackets 372 are U-shaped and include vertically oriented channels to prevent binding as pins 373 rotate about pins 367. Similarly, the connection between bracket 368 and actuator links 366 accommodates the circular movement of actuator links 366 at the locations where bracket 368 and actuator links 366 connect. For example, the portions of actuator links 366 that attach to pin 369 include channels to prevent binding as actuator links 366 rotate about pins 367.

Figure 9:
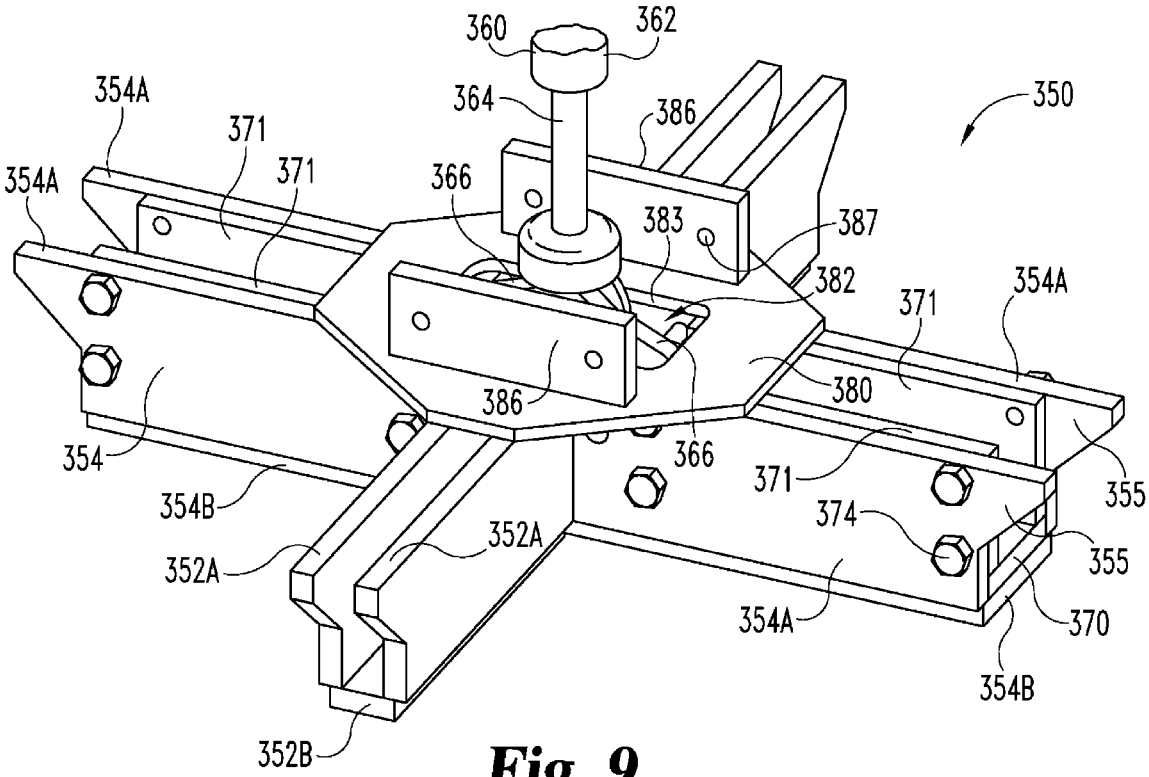
FIG. 9 is a fragmentary perspective view of the manhole clamp depicted in FIG. 3 with a top plate attached and the clamping plates in a retracted position.

Depicted in FIG. 9 is manhole clamp 350 with a top plate 380 attached. Top plate 380 is attached to cross-beam side walls 352A and 354A, such as by welding. Top plate 380 includes an aperture 382 defined by inner edge 383 through which clamping cylinder piston rod 364 extends. As such, top plate 380 does not interfere with the ability of clamping cylinder 360 to push or pull on the one or more actuator links 366, and thereby extend or retract clamping plates 370. Top plate 380 is configured to provide a resting engagement without a fixed connection between clamping cylinder 360 and manhole clamp 350 that allows clamping cylinder 360 to lift clamp 350. For example, aperture 382 is sized to inhibit the removal of the one or more actuator links 366 as clamping cylinder piston rod 360 retracts upwardly. As such, as clamping cylinder piston rod 364 retracts upwardly, the one or more actuator links 366 contact the perimeter of aperture 382, and further upward movement of the one or more actuator links 366 raises the manhole clamp assembly.

Attached to the top of top plate 380 are upwardly extending brackets 386 that rest against the top surface of cutting drum 330 when manhole clamp 350 is in the fully-retracted position to limit the motion of manhole clamp 350 as manhole cutter 300 is maneuvered and transported by, for example, a skid-steer loader.

In use, an operator, for example an operator of a skid-steer loader, positions manhole remover 300 above a manhole (e.g., manhole 130 depicted in FIG. 10) to be removed with the skid-steer loader and preferably centers (at least approximately) manhole remover 300 above the manhole. With extension cylinders 317 retracted and cutting drum 330 raised above manhole clamp 350, skid steer lift arms 120 are lowered, lowering cutting drum 330 and manhole clamp 350 until cross-beams 352 and 354 begin to enter the manhole. As cross-beams 352 and 354 enter into the manhole, sloped portions 353 and 355 of cross-beams 352 and 354 contact the upper rim (upper edge) of the manhole collar (for example upper rim 132 in FIG. 10) and actively center manhole clamp 350 within the manhole. If required, the operator can actuate left-right tilt cylinder 312 and/or the skid steer's hydraulic cylinders 122 and lift arms 120 to align cross-beams 352 and 354 with the manhole.

With manhole clamp 350 resting on the manhole, clamping cylinder 360 is extended. As clamping cylinder piston rod 364 extends, the one or more actuator links 366 rotate and extend the one or more clamping plates 370 in a radial direction from their retracted position (FIG. 7) to their extended position (FIG. 8) to frictionally clamp manhole clamp 350 against the inner diameter of the manhole (see FIG. 10). As such, manhole clamp 350 securely attaches to the inner surface of the manhole. It should be appreciated that manhole clamp 350 can be used to securely attach to manholes of varying sizes, provided the diameter of the manhole is such that clamping plates 370 can be positioned sufficiently within the manhole cover to permit a secure attachment between manhole clamp 350 and the manhole cover, and provided that the diameter of the manhole is no larger than the distance between the outer ends of clamping plates 370 when they are in their fully-extended positions.

After (although optionally before) manhole clamp 350 is secured within the manhole, the operator may actuate drive motor 320 and begin rotating cutting drum 330. The operator may then extend extension cylinders 317 and move the cutting drum 330 downward toward manhole clamp 350, which is secured to the manhole. As points 332 begin cutting through the material surrounding the manhole (e.g., pavement 140 and soil 150 depicted in FIG. 10), downward pressure on cutting drum 330 is maintained using extension cylinders 317. Since the extension arm 314 is securely attached to the manhole by manhole clamp 350, the cutting drum 330 is pulled down around the manhole using the manhole itself as leverage and not relying solely on the weight of the manhole remover 300 and the skid-steer. The secure attachment between the manhole cutter 300 and the manhole further stabilizes manhole cutter 300 and reduces the tendency for the manhole cutter to wander, buck or rock as it penetrates the material, for example a concrete or asphalt road surface, surrounding the manhole.

As cutting drum 330 rotates and extends downward into the surface, points 332 cut through the surface and generate debris that debris removers 334 sweep upward and away from points 332. Debris removed along the outer surface of cutting drum 330 will generally accumulate outside the hole being created by manhole remover 300, and the debris removed along the inner surface of cutting drum 330 will generally accumulate within cutting drum 330. If sufficient debris accumulates within cutting drum 330, debris will begin to exit out of the top of cutting drum 330 through apertures 336.

Figure 10:
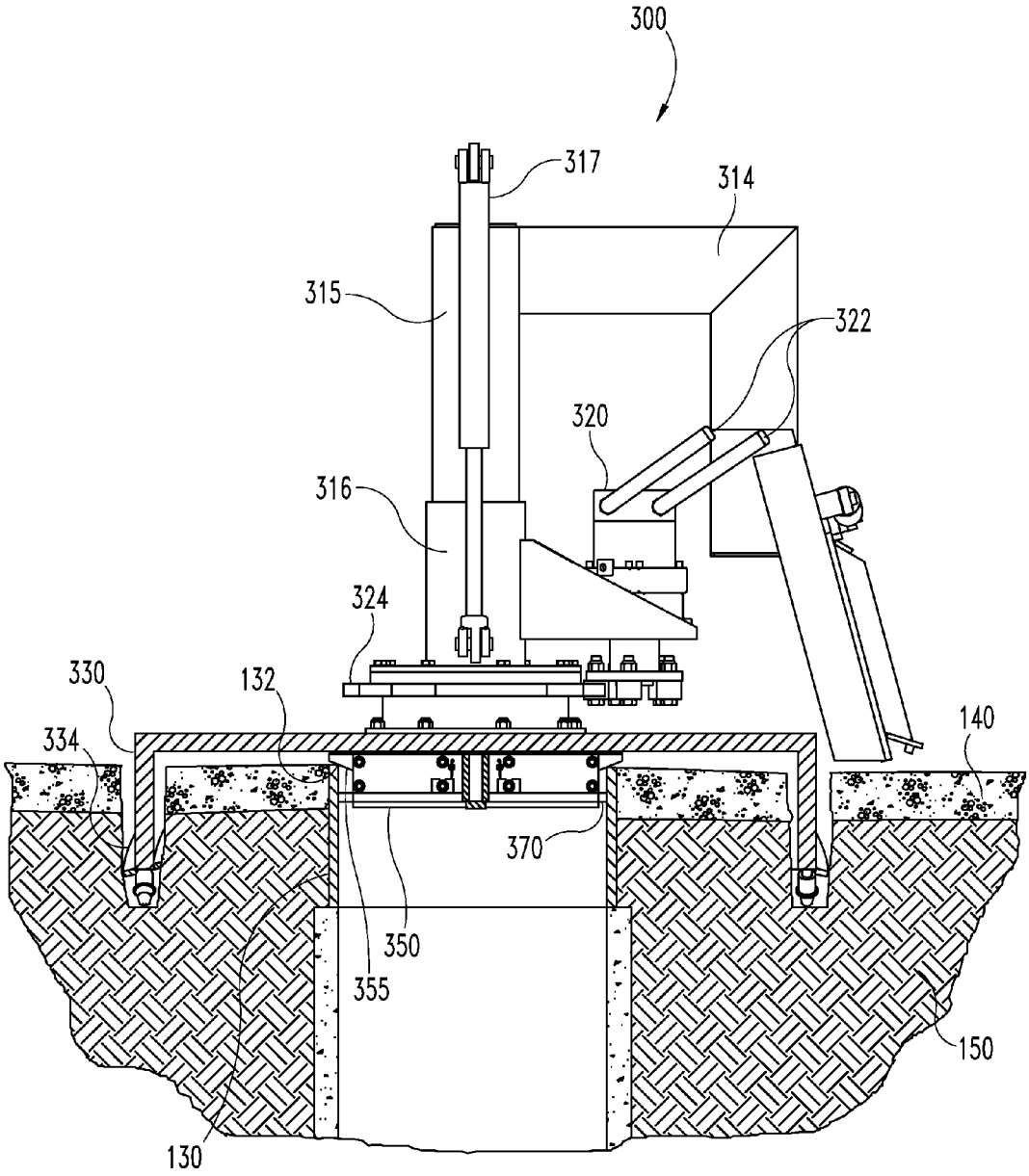
FIG. 10 is a side elevational view of the manhole remover depicted in FIG. 2 attached to a manhole with the cutting drum, clamp, manhole and the material surrounding the manhole in section.
Figure 11:
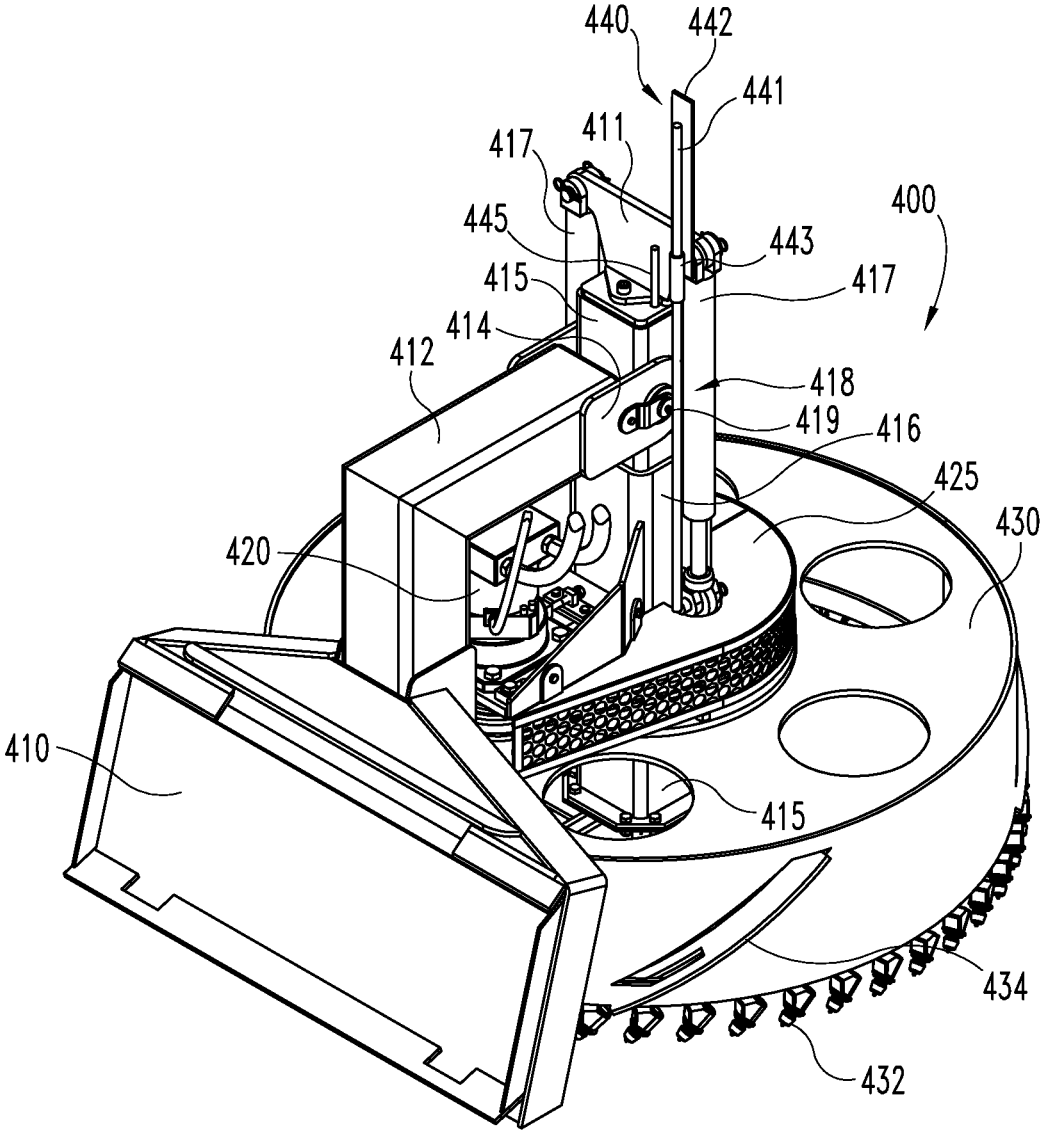
FIG. 11 is a rear perspective view of a manhole remover as viewed from above the manhole remover according to yet another embodiment of the present invention.

In the depicted embodiment, maximum depth is reached when cutting drum 330 abuts manhole clamp 350, as depicted in FIG. 10. (Note that the host machine, e.g., skid-steer loader 100, is not depicted in FIG. 10). However, the operator may stop cutting drum 330 prior to reaching maximum depth if so desired.

Once the manhole remover has penetrated the material surrounding the manhole to a desired depth, the operator can raise skid-steer loader lift arms 120 and move cutting drum 330 and manhole clamp 350 upward. As cutting drum 330 and manhole clamp 350 are raised, downward pressure on bracket 368 and actuator links 366 is maintained by clamping cylinder 360, and the clamping plates 370 are held in their extended position maintaining the positive connection between manhole clamp 350 and the inner surface of the manhole.

Alternately, after the drum rotation is ended, the cylinders 317 can be extended further to lower the cutting drum 330 with respect to the manhole (effectively raising the manhole inside the drum) to break the manhole loose from the surrounding material, after which the skid-steer arms can be used to raise the manhole and the manhole remover 300. As such, the manhole and, typically, some surface material surrounding the manhole, is raised along with cutting drum 330 and clamp 350.

Once the manhole, and possibly some surrounding material, are raised above the ground, the operator may then move the manhole to a desired location. At the desired location, the operator may place cutting drum 330 on the ground. The operator may then retract clamping cylinder 360 and contract clamp 350 by moving the clamping plates 370 to their retracted position. As clamp 350 contracts, manhole clamp 350 releases from the manhole. The operator may then raise the skid steer lift arms 120 and raise manhole clamp 350 and cutting drum 330 away from the manhole and the surrounding material. As such, a single operator can remove a manhole and move it to a desired location without the need for additional personnel or assistance.

Depicted in FIGS. 10-18 is a manhole remover 400 according to another embodiment of the present invention. Manhole remover 400 includes a mounting frame 410, which can be connected to the lift arms 120 of skid-steer loader 100. Attached to mounting frame 410 is extension arm 412, which is pivotally connected to tube 415 at pivot location 418 with bracket 414.

Pin 419 extends through apertures in pivot brackets 414, which are attached to extension arm 412 by, for example, welding, and through corresponding apertures in tube 415. The apertures in tube 415 through which pin 419 extends are offset toward drive motor 420 to balance the off-center displacement of drive motor 420's mass with respect to tube 415 such that tube 415 and cutting drum 430 orient vertically. As such, tube 415 (and the components connected directly to tube 415) are vertically aligned by gravity.

Figure 15:
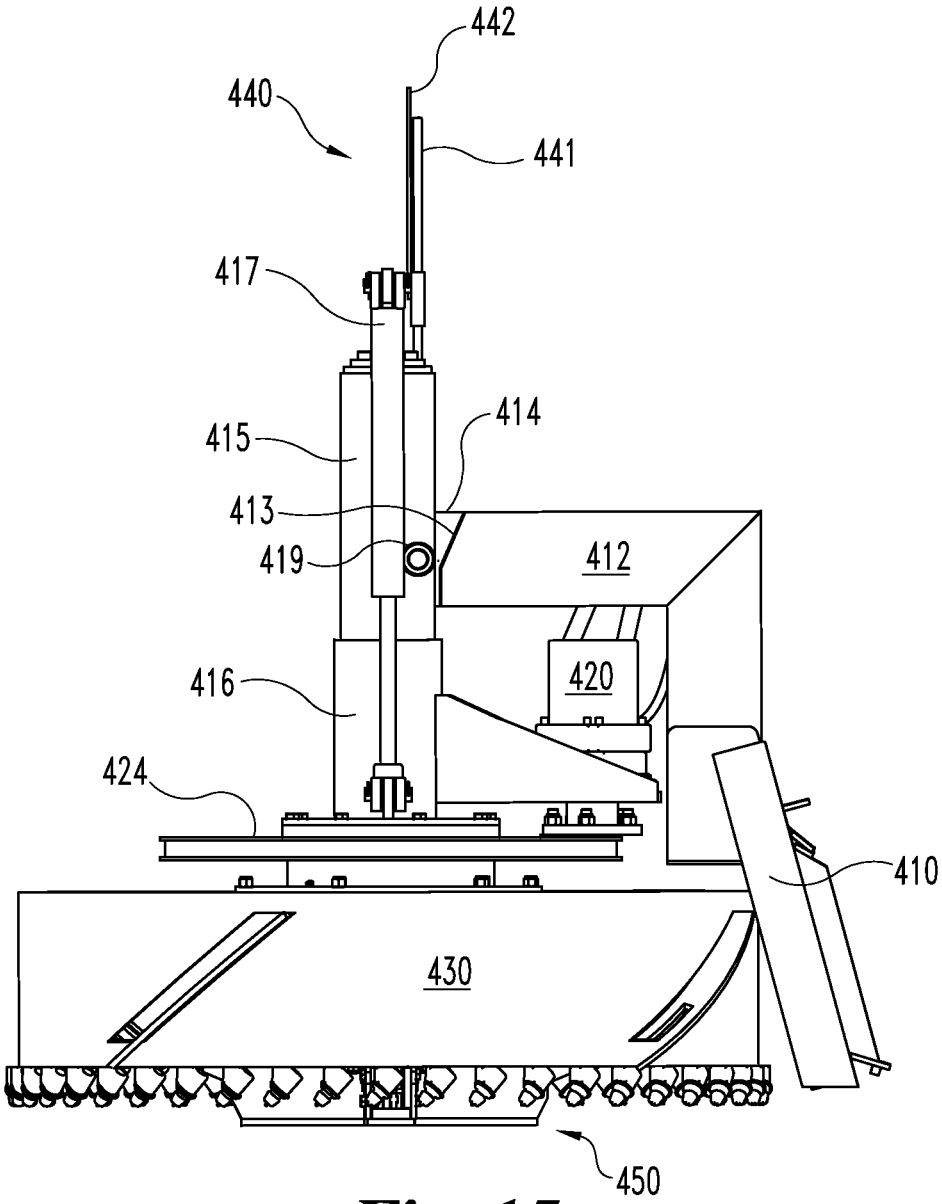
FIG. 15 is a side elevational view of the manhole remover depicted in FIG. 11 with select components not depicted.
Figure 16:
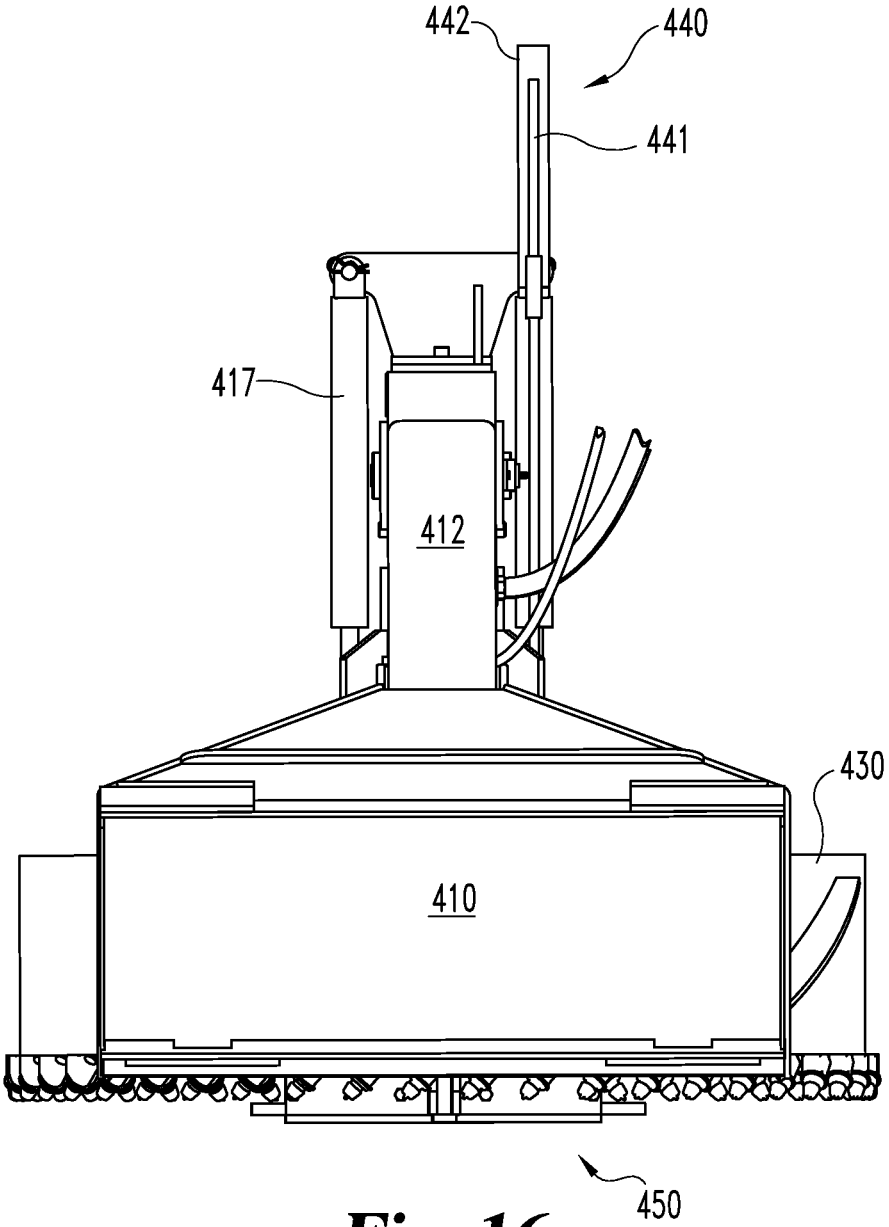
FIG. 16 is a rear elevational view of the manhole remover depicted in FIG. 11.

As can be seen in FIG. 15 (where bracket 414 is not depicted to provide a better view of the end of extension arm 412), the end of extension arm 412 adjacent to tube 415 includes a beveled surface 413 to accommodate situations in which the skid-steer loader may be on an inclined (non-horizontal) surface with tube 415 being vertically oriented and tilted with respect to extension arm 412.

It is also contemplated that the locations of the apertures in tube 415 through which pin 419 extends may be located in positions that result in tube 415 and cutting drum 430 being oriented in a non-vertical (tilted) manner to accommodate locations where the surface surrounding the manhole may be somewhat inclined. Other structures, such as those using two pins that permit tube 415 to align vertically are also contemplated.

A sleeve 416 slidingly engages tube 415 and is connected to a rotatable cutting drum 430. One or more vertical actuators, for example extension cylinders 417, have one end attached to tube 415 (by, for example, a bracket 411) and the other end attached to sleeve 416. By extending the one or more extension cylinders 417, sleeve 416 (and cutting drum 430) lower and advance downward toward the pavement. Conversely, by contracting the one or more extension cylinders 417, sleeve tube 416 (and cutting drum 430) rise and retract away from the pavement.

Cutting drum 430 is similar to cutting drum 330, one difference being that cutting drum 430 is adapted to rotate in the opposite direction to cutting drum 330. For example, cutting points 332 and debris removers 334 of cutting drum 330 are oriented to accommodate a clockwise rotation of cutting drum 330 (as viewed from above the manhole remover looking downward) while cutting points 432 and debris removers 434 of cutting drum 430 are oriented to accommodate a counter-clockwise rotation of cutting drum 430 (as viewed from above the manhole remover looking downward).

Drive motor 420 is attached to sleeve 416 and cutting drum 430. Drive motor 420 rotates cutting drum 430 via a drive belt 424. A guard 425 is optionally connected to sleeve 416 to protect drive belt 424 and other portions of the rotational drive mechanism from damage and debris. In FIG. 15 guard 425 is not depicted to provide a clearer view of drive belt 424 and the rotational drive mechanism for cutting drum 430. Although manhole remover 400 is depicted as utilizing a belt drive, alternate embodiments utilize other drive mechanisms, such as a chain drive, a gear drive or a hydrostatic drive to rotate cutting drum 430.

Manhole remover 400 further includes depth gauge 440. Depth gauge 440 includes a moveable indicator (for example indicator rod 441) that is visible to the operator (within the operator's field of view) and attached to sleeve 416. A stationary scale 442 is attached to tube 415. Indicator rod 441 moves up and down as cutting drum 430 moves up and down. A portion of moveable indicator rod 441 slides within guide 443 as indicator rod 441 moves up and down. The relative position of indicator rod 441 with respect to scale 442 indicates the extent to which extension cylinders 417 have extended and the depth to which cutting drum 430 has penetrated into the surface surrounding the manhole cover. Graded markings, color tabs, or other type of markings may be included on scale 442 to assist the operator in determining the precise depth to which cutting drum 430 has penetrated.

Figure 12:
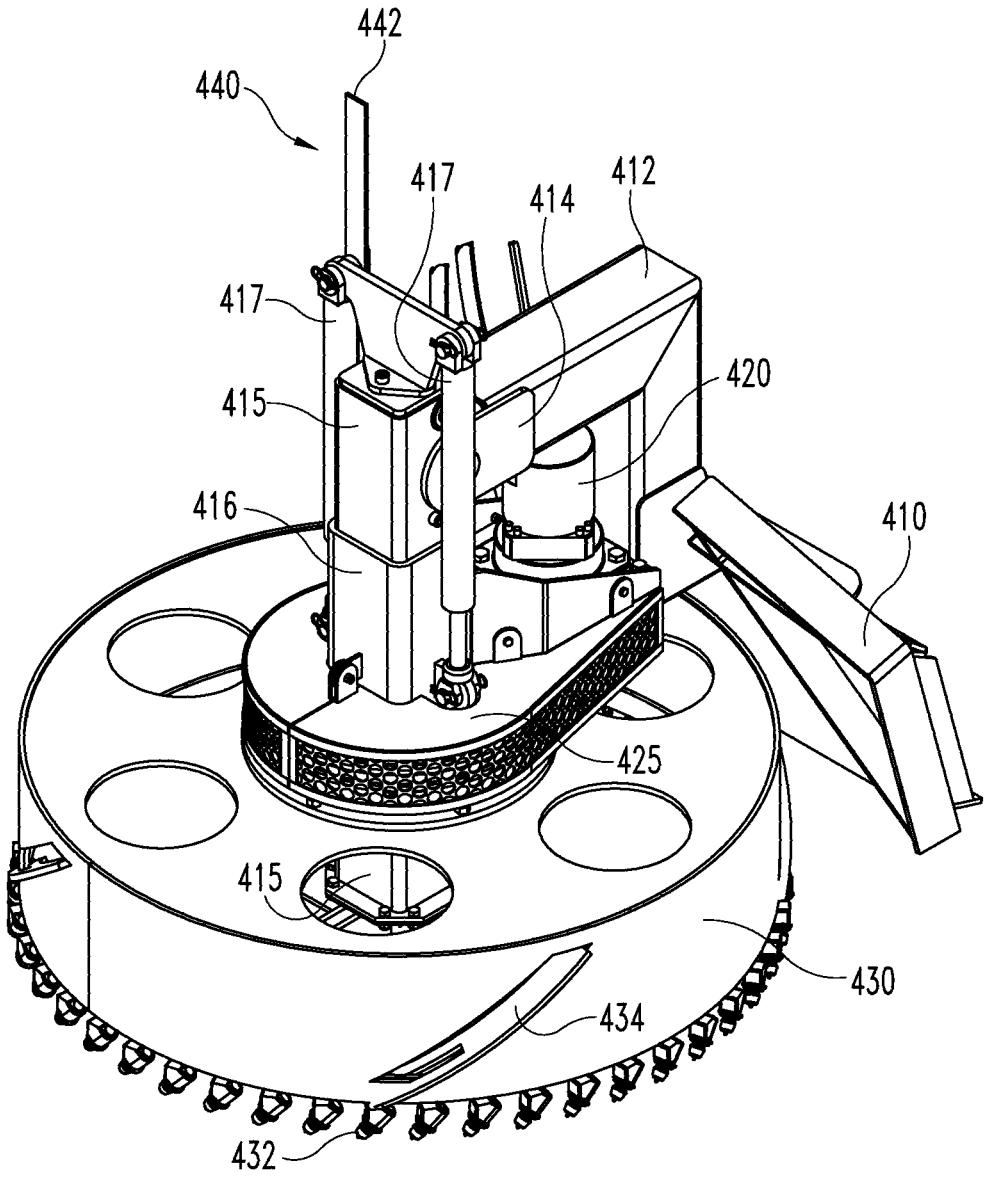
FIG. 12 is a front perspective view of the manhole remover depicted in FIG. 11 as viewed from above the manhole remover.
Figure 13:
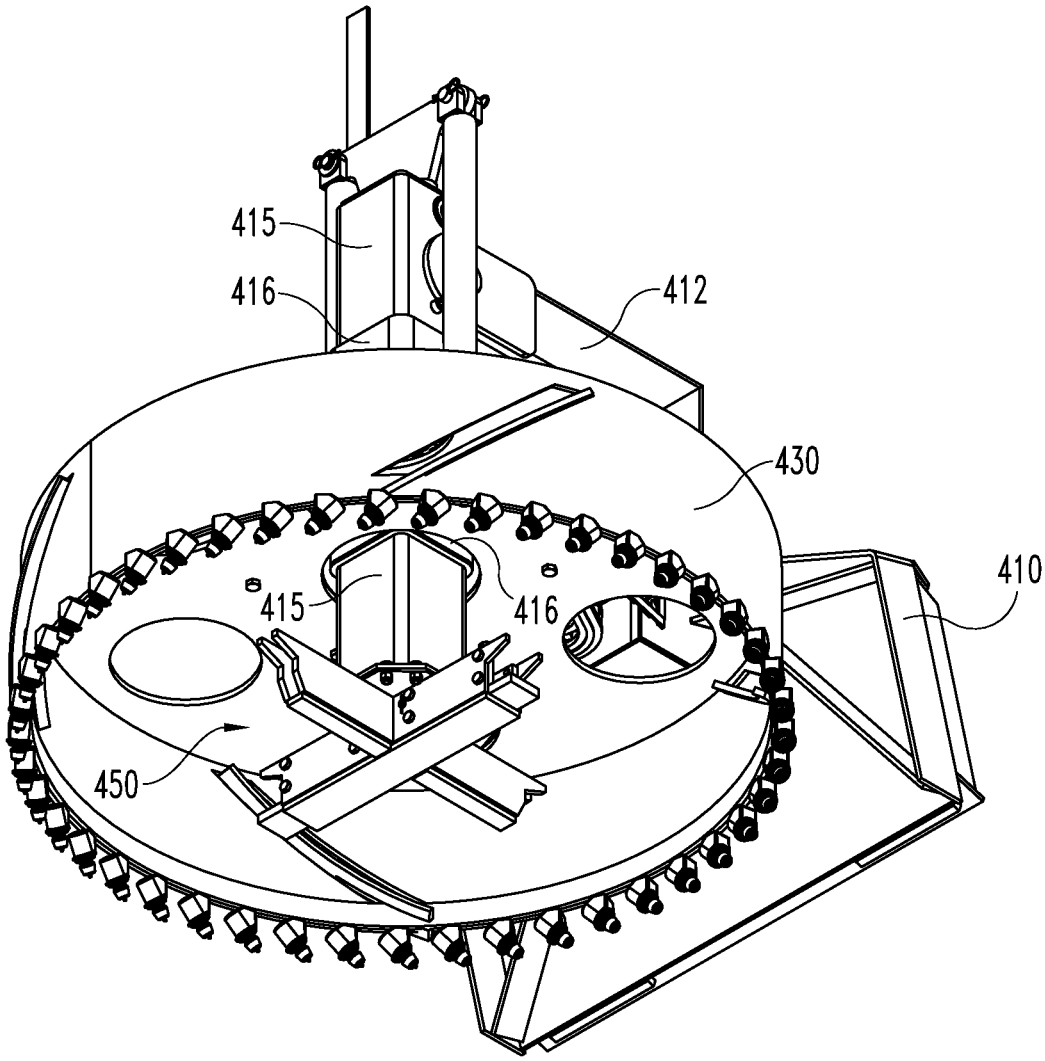
FIG. 13 is a front perspective view of the manhole remover depicted in FIG. 11 as viewed from beneath the manhole remover.
Figure 14:
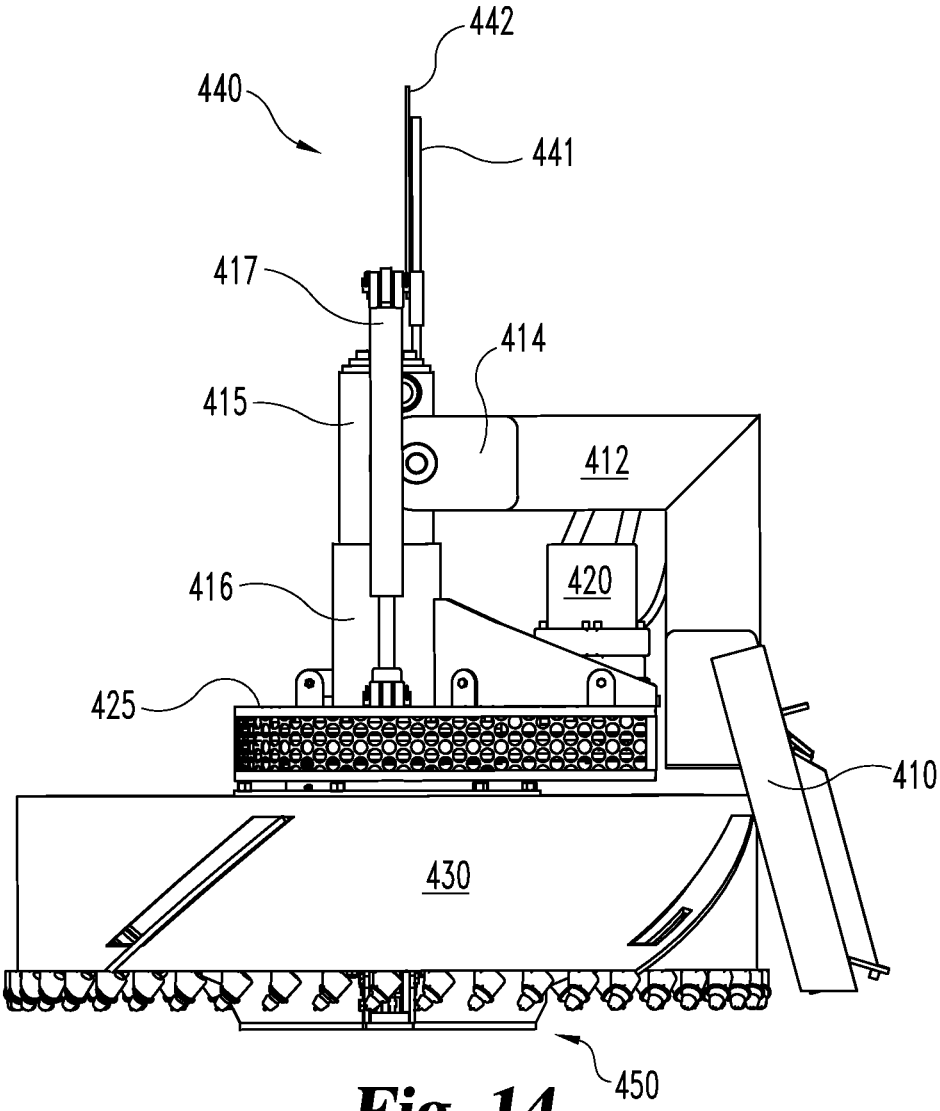
FIG. 14 is a side elevational view of the manhole remover depicted in FIG. 11.
Figure 17:
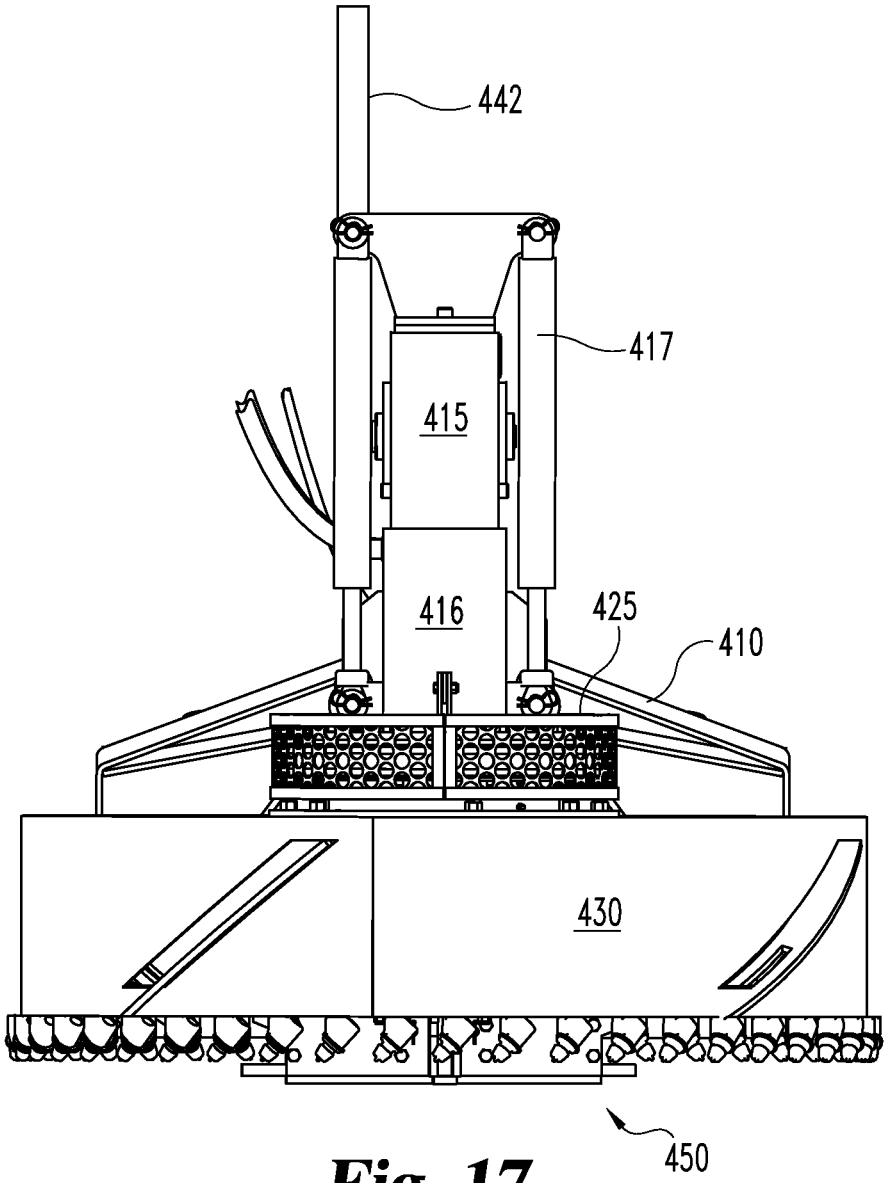
FIG. 17 is a front elevational view of the manhole remover depicted in FIG. 11.
Figure 18:
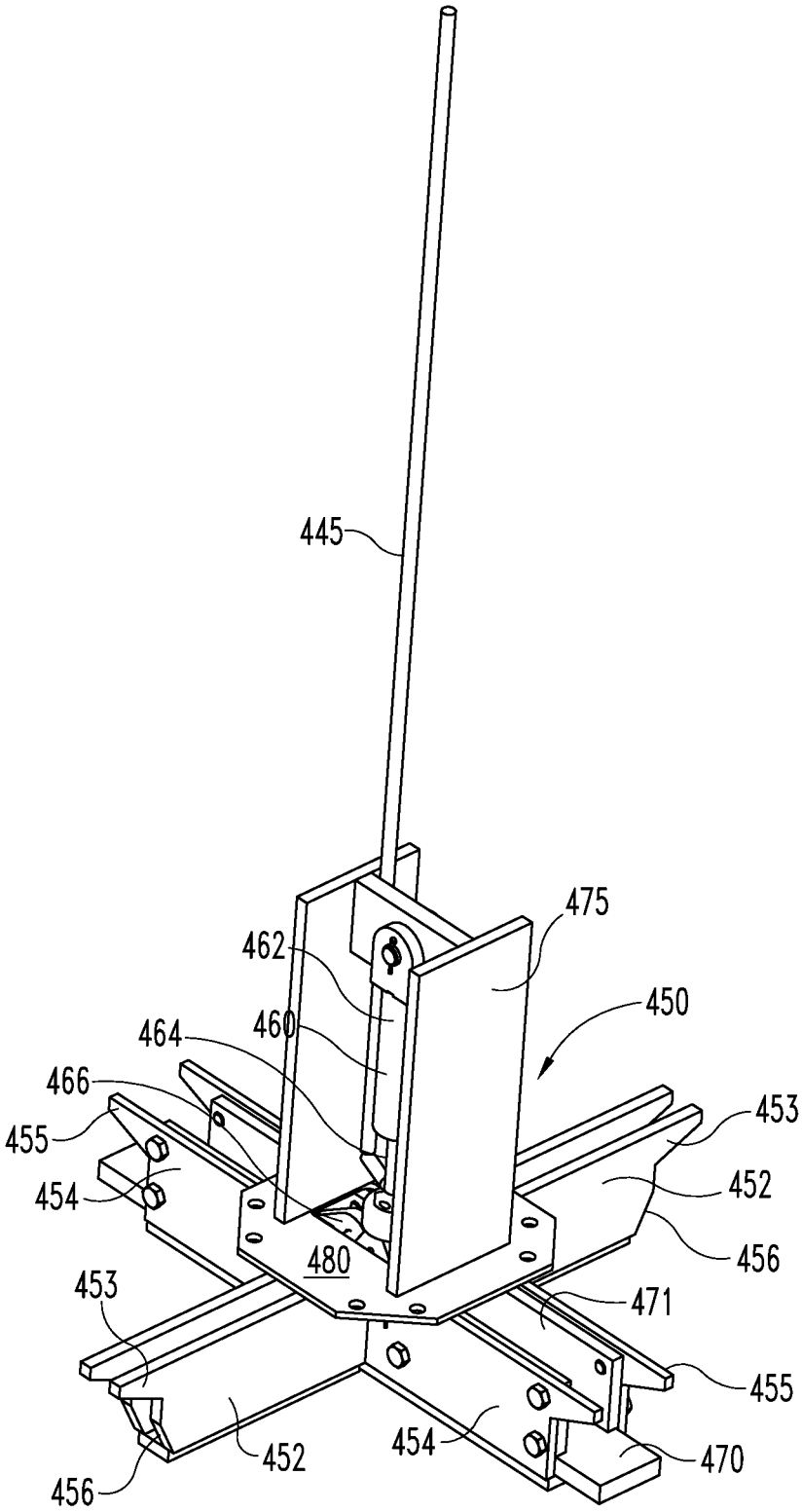
FIG. 18 is a perspective view of the clamp depicted in FIG. 13 from a different perspective from that depicted in FIG. 13.
Figure 19:
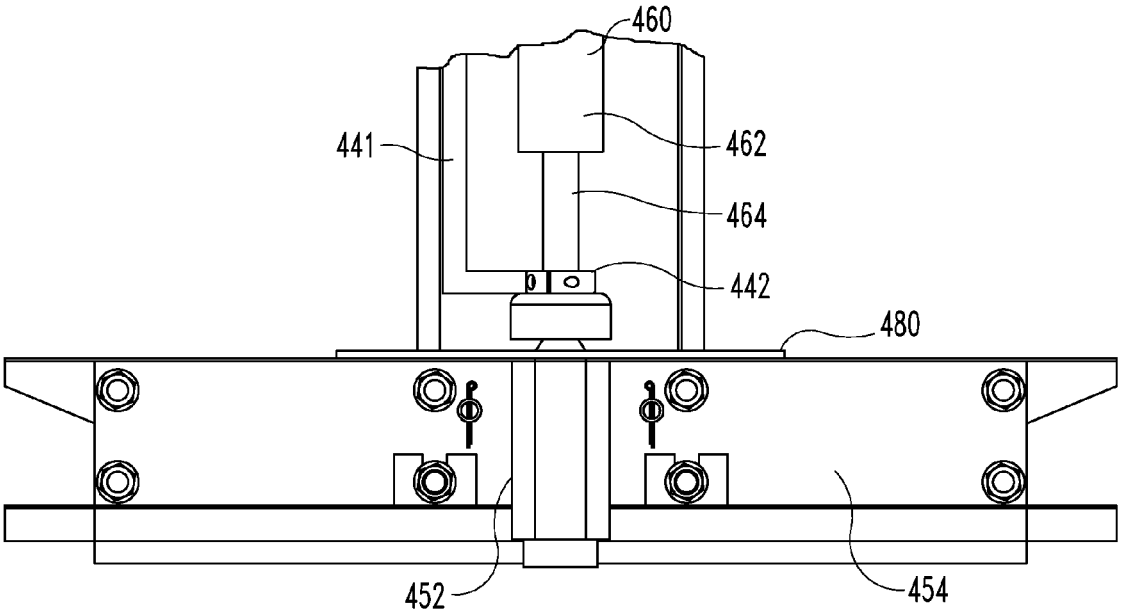
FIG. 19 is a fragmentary side elevational view of the clamp depicted in FIG. 18.

With reference to FIGS. 12, 17 and 18, a powered clamp 450 is attached to the lower end of tube 415. As used herein, powered indicates that the forces exerted by an object to perform a task do not result from the direct application of a force by a person (for example, hand tools such as wrenches and hammers are not powered) but instead result from direct application of a force by a different source (such as, for example, a hydraulic piston, electric motor, or internal combustion engine). Pneumatic wrenches, hydraulic wrenches, and electric drills are examples of powered tools.

Clamp 450 is an expanding-type clamp that attaches to the inner surface of the manhole to be removed and is similar to manhole clamp 350. Clamp 450 includes crossbeams, for example crossbeams 452 and 454, that extend at least partially into the manhole (after the manhole cover is removed) as clamp 450 is lowered onto and into the manhole. Crossbeams 452 and 454 are structurally and operationally similar to crossbeams 352 and 354 as described above. For example, clamp 450 includes brackets 471 and clamping plates 470 that operate and are actuated in a similar manner to brackets 371 and clamping plates 370 in manhole clamp 350. Crossbeams 452 optionally include additional sloped centering portions 456 located below sloped centering portions 453. The additional centering portions 456 further assist in centering clamp 450 on the manhole, and may optionally be included on crossbeams 454.

A top plate 480 is attached to crossbeams 452 and 454 by, for example, welding. Attached to and extending upward from top plate 480 is bracket 475 as best seen in FIG. 17. Connected to bracket 475 is an actuator (for example, clamping cylinder 460), which is adapted to control the extension and/or retraction of clamping plates 470. Clamping cylinder 460 includes cylinder barrel 462, which is attached to bracket 475, and piston rod 464, which is attached to actuator links 466. Although not depicted in great detail in FIG. 17, actuator links 466 are similar in construction and operation to actuator links 366 depicted in FIGS. 7 and 8.

A clamp indicator 445 is attached to piston rod 464 and moves up and down as piston rod extends and retracts, respectively, in relation to cylinder barrel 422. Clamp indicator 445 extends through an aperture in the top portion of tube 415 to permit observation by the operator of manhole remover 400 (see FIG. 10). As such, by observing clamp indicator 445, the operator can determine the extent to which clamping plates 470 are extended and/or retracted. By using a scale on, for example, bracket 411 (or marked on indicator 445 as it enters tube 415), the operator can also determine the diameter of the manhole at the location where clamp 450 is attached.

Clamp 450 is attached to the bottom of tube 415 by inserting bracket 475 and indicator rod 441 inside tube 415 and securing top plate 480 to the bottom of tube 415. Top plate 480 is secured to tube 415 with bolts, which allow for easy attachment and/or removal of clamp 450 from tube 415, such as for maintenance, although other means of securing clamp 450 to tube 415 are also contemplated.

In a manner similar to the operation of actuator links 366 and clamping plates 370 of clamp 350, as clamping cylinder piston rod 464 extends downward and pushes on the one or more actuator links 466, the one or more actuator links 466 pivot and push clamping plates 470 outward, slidingly clamping plates 470 from a retracted position (similar to the retracted position of clamping plates 370 depicted in FIGS. 7 and 9) to an extended position (as depicted in FIGS. 12 and 15-18). As clamping cylinder 460 retracts, piston rod 464 moves upward and pulls upward on the one or more actuator links 466, which pivot and pull clamping plates 470 from an extended position to a retracted position.

In use, an operator, for example an operator of a skid-steer loader, maneuvers the skid-steer loader to position manhole remover 400 above a manhole to be removed (for example manhole 130 in FIG. 1). Cutting drum 430 and clamp 450 are free to pivot around pivot location 418 and preferably remain vertically oriented by gravity similar to a plumb line. Skid-steer lift arms 120 are then lowered, lowering cutting drum 430 and clamp 450 until cross-beams 452 and 454 begin to enter the manhole. Provided that clamping plates 470 have been sufficiently retracted to avoid contact with the manhole as it is lowered, sloped centering portions 453 and 455 of cross-beams 452 and 454 (similar to the sloped portions of cross-beams 352 and 354) contact the upper rim (upper edge) of the manhole collar and actively center clamp 450 within the manhole.

After clamp 450 is positioned on the manhole, the operator (from the operator's work station) remotely actuates and extends the clamping cylinder 460 and expands clamp 450. As clamping cylinder piston rod 464 extends, actuator links 466 rotate and radially extend the one or more clamping plates 470 outward to the extended position (see FIGS. 12 and 15-18) to engage clamp 450 against the inner diameter of the manhole, thereby securing attaching clamp 450 to the inner surface of the manhole. It should be appreciated that clamp 450 can be used to securely attach to manholes of varying sizes, provided the diameter of the manhole is such that clamping plates 470 can be positioned sufficiently within the manhole cover to permit a secure attachment between clamp 450 and the manhole cover, and provided that the diameter of the manhole is no larger than the distance between the outer ends of clamping plates 470 when they are in their fully-extended positions. By observing indicator rod 441, the operator can determine the extent to which clamping plates 470 are extending and/or retracted.

After securing clamp 450 to the manhole, the operator actuates drive motor 420 and rotates cutting drum 430. Extension cylinders 417 move cutting drum 430 downward toward clamp 450, which is secure to the manhole. As cutting drum 430 is lowered, points 432 cut through the material surrounding the manhole. The secure connection between tube 415, clamp 450 and the manhole allows the manhole itself to be used as leverage to move (forcibly if necessary) cutting drum 430 down around the manhole without necessarily relying merely on the weight of the manhole remover 400 and the skid-steer. As cutting drum 430 rotates and extends downward into the surface, cutting drum 430 cuts through the surface and removes debris in a similar fashion to cutting drum 330 as described previously. As cutting drum 430 cuts into the material surround the manhole, the operator can determine the depth of penetration using depth gauge 440 and by observing the movement of moveable indicator rod 441 with respect to scale 442.

Once the manhole remover has penetrated the material surrounding the manhole to a desired depth, the operator can raise skid-steer lift arms 120 and move cutting drum 430 and clamp 450 upward. The operator can optionally retract extension cylinders 417 while maintaining the secure connection between clamp 450 and the manhole to facilitate the material surrounding the manhole in falling away from the manhole. When desired, the operator can contract clamp 450 by actuating clamping cylinder 460 to retract clamping plates 470 and release the manhole from clamp 450.

As such, a single operator working from a single control station can secure the manhole remover to the manhole, remove material from around the manhole utilizing the manhole itself as leverage, remove the manhole (and optionally some or all of the material surrounding the manhole), move the manhole to another location, and release the manhole from the manhole remover 400 without requiring the operator to leave the control station and without requiring additional personnel or assistance.

Although a number of the actuators are depicted as being hydraulically powered, it should be appreciated that other types of actuators may be used in alternate embodiments. For example, alternate embodiments use electrically-powered actuators while still other embodiments utilize mechanically-powered actuators.

Furthermore, while the hydraulic cylinders have been depicted in a particular orientation with the cylinder barrel being connected to one item ("Item A") and the piston rod being connected to another item ("Item B"), it is contemplated that the opposite orientation may be utilized with the cylinder barrel being connected to Item B and the piston rod being connected to Item A.

Alternate embodiments further include manhole clamps that optionally descend entirely into the manhole.

It should be appreciated that while in the depicted embodiment actuator links 366 are generally configured as bell cranks, actuator links 366 may take other forms provided that the one or more clamping plates 370 extend outwardly and retract inwardly as clamping cylinder 360 extends and retracts.

Furthermore, although bottom plates 352B and 354B are depicted as separate plates that are attached to one another by, for example, welding, it should be appreciated that bottom plates 352B and 354B may take on other forms, such as a single-piece x-shaped plate, provided that the proper functioning of manhole clamp 350 is maintained.

Although the above examples describe devices used to remove manholes from their surrounding material, alternate embodiments of the present invention are used to remove other objects (such as hand holes, pipes or various other structures that include a hollow portion to which the clamp may be attached) from their surrounding material.

While illustrated examples, representative embodiments and specific forms of the invention have been illustrated and described in detail in the drawings and foregoing description, the same is to be considered as illustrative and not restrictive or limiting. The description of particular features in one embodiment does not imply that those particular features are necessarily limited to that one embodiment. Features of one embodiment may be used in combination with features of other embodiments as would be understood by one of ordinary skill in the art, whether or not explicitly described as such. Dimensions, whether used explicitly or implicitly, are not intended to be limiting and may be altered as would be understood by one of ordinary skill in the art. Only exemplary embodiments have been shown and described, and all changes and modifications that come within the spirit of the invention are desired to be protected.

What is claimed is:

1. A manhole remover, comprising:

a radially expanding powered clamp controlled with powered clamp actuator adapted to be placed at least partially into a manhole and operated to expand to engage the inner surface of a manhole, the clamp actuator adapted to be remotely actuated by an operator from a control station;

a powered cutting drum connected to the radially expanding clamp and adapted to rotate around the clamp, the drum adapted to cut into a surface surrounding a manhole and to be remotely actuated by an operator from the control station; and a powered extension actuator connected to the clamp and to the drum, the extension actuator adapted to extend and move the drum downward relative to the clamp while the drum is rotating and while the clamp is engaged with the inner surface of a manhole to cut into the surface surrounding the manhole, the actuator adapted to be remotely actuated from the control station.

2. The manhole remover of claim 1, wherein the radially expanding powered clamp includes two perpendicularly arranged cross-beams, one cross-beam including at least one plate adapted to slide in a direction along a radial axis of the manhole to selectably engage with and disengage from the inner surface of the manhole.

3. The manhole remover of claim 1, wherein the radially expanding powered clamp includes two perpendicularly arranged cross-beams, each cross-beam including sloped portions adapted to engage the upper rim of the manhole to self-center the clamp on the manhole as the clamp is placed at least partially into the manhole.

4. The manhole remover of claim 1, wherein the radially expanding powered clamp includes a first manhole engagement plate adapted to move in a generally horizontal direction and to selectably engage with and disengage from the manhole inner surface;

a first bell crank pivotally connected to the first engagement plate; and wherein said clamp actuator is adapted to move in a generally vertical direction and pivotally connected to the first bell crank, the vertical movement of the actuator being controlled from a control station;

wherein movement of the clamp actuator in a first direction rotates the first bell crank and moves the first engagement plate outward to engage the inner surface of the manhole; and wherein movement of the clamp actuator in a direction opposite to the first direction rotates the first bell crank and moves the first engagement plate inward to retract from the inner surface of the manhole.

5. The manhole remover of claim 4, wherein the pivotal connection between the first engagement plate and the first bell crank is formed by a pin attached to one of the plate and the bell crank, and a U-shaped bracket pivotally embracing the pin and attached to the other of the plate and the bell crank.

6. The manhole remover of claim 4, comprising:

an indicator rod with a first end connected to the clamp actuator and a second end positioned to be in the line of sight of an operator of the manhole remover while at the control station, wherein the position of the indicator rod second end indicates the position of the first manhole engagement plate.

7. The manhole remover of claim 1, wherein said powered clamp actuator is arranged vertically in a passage through said cutting drum wherein said powered cutting drum is adapted to rotate around the clamp actuator.

8. A method, comprising:

positioning a powered clamp within a manhole;

remotely actuating a clamping actuator associated with the powered clamp from a control station causing said clamp to expand to anchor the clamp within the manhole;

actuating a cutting device to cut material surrounding the manhole, the cutting device being connected to the clamp; and applying a force to the cutting device braced against the anchored clamp to move the cutting device into the material surrounding the manhole.

9. The method of claim 8, comprising:

controlling from a single control station said positioning, said actuating of said powered clamp, said actuating of said cutting device, and said applying a force.

10. The method of claim 8, wherein actuating the powered clamp includes applying a powered force to radially expand the clamp to engage the inner surface of the manhole with the clamp.

11. The method of claim 10, wherein said positioning comprises:

lowering a sloped portion of the clamp onto the manhole rim to center the clamp with respect to the manhole.

12. The method of claim 10, comprising:

raising the manhole above the surface of the surrounding material by raising the clamp while the clamp is anchored to the manhole;

moving the manhole to a location different than the location at which the manhole was raised; and releasing the manhole from the clamp by contracting the clamp and disengaging the clamp from the inner surface of the manhole;

wherein said actuating said cutting device includes rotating a cutting drum in relation to the clamp.

13. The method of claim 12, comprising:

controlling from a single control station said expanding, said rotating, said applying a force, said raising, said moving, and said contracting.

14. The method of claim 8, comprising rotating said cutting device around a powered clamp actuator.

15. An apparatus, comprising:

a radially expanding clamp adapted to securely engage the inner surface of a manhole, the clamp including at least a first manhole engagement plate adapted to move in a generally horizontal direction and to selectably engage with and disengage from the manhole inner surface, at least a first bell crank pivotally connected to the engagement plate, and a clamp actuator adapted to move in a generally vertical direction and pivotally connected to the bell crank, the vertical movement of the clamp actuator being controlled from a control station;

wherein movement of the clamp actuator in a first direction rotates the first bell crank and moves the first engagement plate outward to engage the inner surface of the manhole; and wherein movement of the clamp actuator in a direction opposite to the first direction rotates the bell crank and moves the first engagement plate inward to retract from the inner surface of the manhole.

16. The apparatus of claim 15, wherein the radially expanding clamp includes two perpendicularly arranged cross-beams, one cross beam including the manhole engagement plate and the bell crank.

17. The apparatus of claim 16, wherein the cross-beams include sloped portions adapted to engage the manhole and self-center the clamp as the clamp is lowered onto a manhole.

18. The apparatus of claim 15, comprising:

a second manhole engagement plate; and a second bell crank pivotally connected to the clamp actuator and pivotally connected to the second engagement plate;

wherein movement of the clamp actuator in the first direction rotates the second bell crank in a direction opposite to that in which the first bell crank rotates, and moves the second engagement plate outward to engage the inner surface of the manhole and in a direction opposite to what in which the first engagement plate moves.

19. The apparatus of claim 15, comprising:

a rotating drum attached to the radially expanding clamp and adapted to rotate with respect to the clamp while the clamp is securely engaged with the inner surface of a manhole, the rotating drum being controlled from the control station; and a vertical actuator attached to the rotating drum and the clamp, the vertical actuator being adapted to forcibly move the rotating drum vertically in relation to and against the clamp, the vertical actuator being controlled from the control station.

20. The apparatus of claim 15, wherein the pivotal connection between the first engagement plate and the first bell crank is formed by a pin attached to one of the plate and the bell crank, and a U-shaped bracket pivotally embracing the pin and attached to the other of the plate and the bell crank.

* * * * *